United States Patent [19]

Oesterle et al.

[11] Patent Number: 4,593,236

[45] Date of Patent: Jun. 3, 1986

[54] REGULATION DEVICE FOR THE ROTARY DRIVE OF A SUPPLY ROLL DEVICE, ESPECIALLY A WARP BEAM OF A WEAVING MACHINE

[75] Inventors: Gerhard Oesterle, Koblach, Austria; Wilhelm Hutter, Roggwil, Switzerland

[73] Assignee: Aktiengesellschaft Adolph Saurer, Arbon, Switzerland

[21] Appl. No.: 653,557

[22] Filed: Sep. 24, 1984

[30] Foreign Application Priority Data

Oct. 4, 1983 [CH] Switzerland ..... 5393/83

[51] Int. Cl.[4] ..... B65H 59/38

[52] U.S. Cl. ..... 318/7; 318/6; 242/75.44

[58] Field of Search ..... 318/6, 7; 242/26.2, 242/26.3, 26.4, 75, 75.1, 75.2, 75.5, 75.51, 75.44, 84.1, 147 R, 190

[56] References Cited

U.S. PATENT DOCUMENTS 3,324,363 6/1967 Hill et al. ..... 318/6
4,513,790 4/1985 Sainen et al. ..... 242/75.44

FOREIGN PATENT DOCUMENTS 0856959 8/1981 U.S.S.R. ..... 318/6
0861261 9/1981 U.S.S.R. ..... 318/7

*Primary Examiner*—Bernard Roskoski
*Assistant Examiner*—Bentsu Ro
*Attorney, Agent, or Firm*—Werner W. Kleeman

[57] ABSTRACT

A regulation device for the rotary drive of a warp beam of a weaving machine for producing as uniform as possible a tension force on an unwinding material or group of warp threads conducted to a weaving device and then to a fabric take-up device. A tachometer is associated with a power regulator arranged ahead of the motor of the rotary drive as a momentary value transducer and comprises a generator for generating a signal corresponding to the tension force or tensile stress in the material or warp threads as well as a further generator for generating a signal corresponding to the take-up speed of the fabric being woven from the unwinding material or threads. These two signals are connected to a multiplier stage whose output signal is conducted to the power regulator of the rotary drive as a reference value. This feedback regulation of the rotary drive of the warp beam in dependence of the momentary tension force or in the unwinding material or threads and of the momentary take-up speed of the woven fabric by, multiplying the corresponding potential values of the signals for generating the corresponding reference value signals for the rotary drive, renders it possible to achieve a high constancy of the tension force on the unwinding material or threads even under non-uniform conditions in the further processing of the fabric.

7 Claims, 1 Drawing Figure

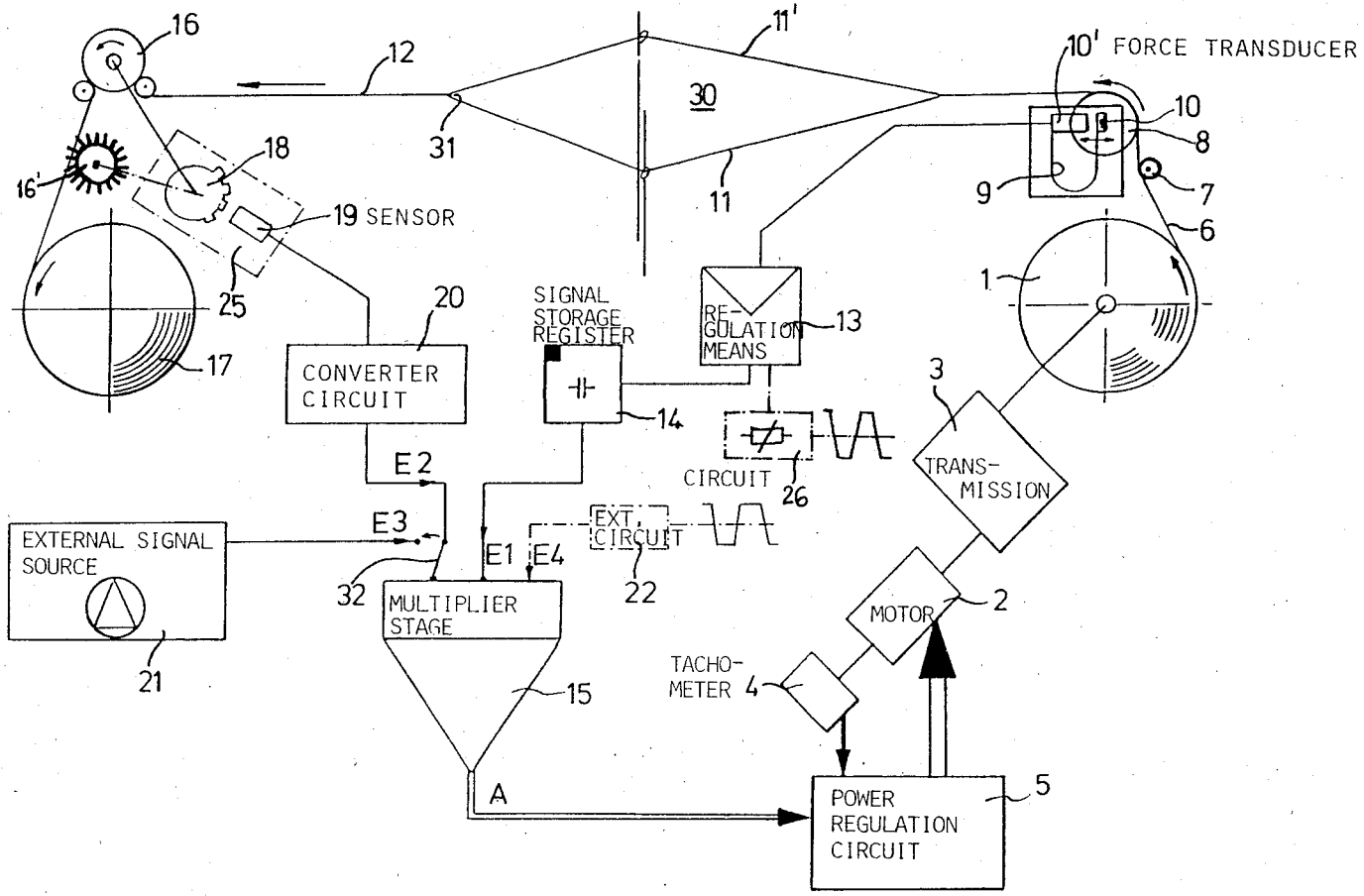
FORCE TRANSDUCER
10'
10
8
7
6
9
1
3
TRANS-
MISSION
2
MOTOR
5
POWER
REGULATION
CIRCUIT
4
TACHO-
METER
13
RE-
GULATION
MEANS
26
CIRCUIT
11'
11
30
14
SIGNAL
STORAGE
REGISTER
EXT.
CIRCUIT
22
E4
E1
15
A
MULTIPLIER
STAGE
31
12
20
CONVERTER
CIRCUIT
E2
E3
32
19 SENSOR
18
25
17
16
16'
EXTERNAL SIGNAL
SOURCE
21

REGULATION DEVICE FOR THE ROTARY DRIVE OF A SUPPLY ROLL DEVICE, ESPECIALLY A WARP BEAM OF A WEAVING MACHINE

BACKGROUND OF THE INVENTION

The present invention broadly relates to weaving machines and, more specifically, pertains to a new and improved construction of a regulation device for the rotary drive of a supply roll, especially a warp beam of a weaving machine.

Generally speaking, the regulation device of the present invention is for the generation of as uniform as possible a tension force or tensile stress in an unwinding material or group of warp threads to be conducted to a further processing device or weaving device and thence to a fabric take-up device, wherein a tachometer is associated with a rotary drive as a momentary value transducer for a power regulator arranged ahead of the motor of the rotary drive.

In unwinding or let-off devices of the previously mentioned type, especially in warp beams of weaving machines, it is usual to employ only the tension force of the material or group of warp threads being unwound as a control value for the regulation of the rotary drive. Normally this is done by deflecting or guiding the material or threads being unwound over a sensor roll. As a rule, the sensor roll is spring-loaded so that the momentary position of the sensor roll in relation to a fixed point represents a measure for the tension force of the material or threads being unwound or let-off. Deviations from this position, which corresponds to the desired tension force, are then employed to develop rotary speed corrections to be undertaken upon the rotary drive (cf. Swiss Pat. No. 629,549).

The small and rapid variations of tension force, i.e. of the position of the sensor roll, during the further processing, for instance during the formation of the shed and during the beat-up of the reed in a weaving machine, must however be neglected if excesses in the design of the regulation device and overloading of the regulation device are to be avoided. This is usually achieved in that relatively slowly responding regulation devices are employed. This, however, has the disadvantage that under non-uniform conditions of a process—such as for instance changes in the processing speed when a certain length of material or fabric is allowed to run free, for instance of a certain length of warp without weft thread insertion in a so-called fringe border of terry-cloth, where a more rapid passage through the weaving machine is advantageous, or a controlled alteration of the take-up speed of the processed or woven material or fabric, or when starting or stopping the machine—the tension force only gradually attains its reference or set value or must be artificially regulated, for instance by tensioning the warp manually when restarting the weaving machine after eliminating the cause of a breakdown.

SUMMARY OF THE INVENTION

Therefore, with the foregoing in mind, it is a primary object of the present invention to provide a new and improved construction of a regulation device for the rotary drive of a supply roll device, especially of a warp beam of a weaving machine which does not exhibit the aforementioned drawbacks and shortcomings of the prior art constructions.

Another and more specific object of the present invention aims at providing a new and improved construction of a regulation device of the previously mentioned type which, while avoiding the previously mentioned disadvantages of the known state of the prior art, is able to maintain a high constancy of the tension force or tensile stress in the unwinding material or warp threads even under non-uniform conditions in the further processing of the material or fabric being woven from the warp threads.

Yet a further significant object of the present invention aims at providing a new and improved construction of a regulation device of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the regulation device of the present invention is manifested by the features that it comprises first means for generating a first electrical signal corresponding to the tension force or tensile stress in the material or group of warp threads being unwound or let-off, second means for generating a second electrical signal corresponding to a take-up speed of the fabric being woven from the warp threads being let-off, a multiplier stage arranged subsequent to the first and second means for generating electrical signals and generating an output signal, the first and second electrical signals being input to the multiplier stage and the output signal being conducted to the power regulator as a reference or set value.

That is, according to the invention, there are provided means for generating an electrical signal corresponding to the tensile stress in the unwinding material or warp threads as well as further means for generating an electrical signal corresponding to the fabric take-up speed of the processed material or fabric, which signals are applied to a subsequently arranged multiplier stage whose output signal is conducted to the power regulator of the rotary drive as a reference or set value.

By this feedback regulation of the rotary drive of the warp beam in dependence of the momentary tensile stress or tension force in the unwinding material or group of warp threads and of the momentary fabric take-up speed of the processed material or fabric by, in the present case, a multiplication of the corresponding potential values of the signals for generating the appropriate reference or set value signal for the rotary drive, a high constancy of the tensile stress or tension force in the unwinding material or group of warp threads can now be achieved even under non-uniform conditions in the further processing of the material or fabric.

In order to achieve a practically maintenance-free, robust and simple design of the regulation device according to the invention it is advantageous for the means for generating an electrical signal corresponding to the tensile stress or tension force in the unwinding material or group of warp threads to comprise a swingingly supported sensor roll upon which the material or group of warp threads is guided as well as a force transducer. It is also advantageous for the latter to be connected through regulation means and storage means to the input of a multiplier stage. It is further advantageous for the means for generating an electrical signal corresponding to the fabric take-up speed of the processed material or fabric to comprise a fabric take-up roll or breast beam around which the taken-up material or fabric is wound and which is rotatably driven by a regulator drive as well as a rotary speed measurement device determining the rotary speed of the regulator drive or of the breast beam or a speed measurement device measuring the take-up speed of the processed material or fabric. It is advantageous for the speed measurement device to be connected through a convertor circuit to the other input of the multiplier stage.

A further advantageous embodiment of the regulation device according to the invention consists in that an externally controlled source for generating a multiplier signal which is independent of the take-up speed of the processed material or fabric is connected through a third input to the multiplier stage. In this case, the second and third input are alternatively connectable to the multiplier stage by switching means. These measures make it possible to generate a reference value or signal at the output of the multiplier stage dependent upon the third input signal from the externally controlled source while eliminating the electrical signal corresponding to the take-up speed of the processed material or fabric. It is thereby possible to perform idle functions in the weaving machine by an appropriate feedback regulation of the rotary drive of the warp beam.

A further advantageous embodiment of the invention consists in that the multiplier stage is connected by a further input to a circuit for generating a further electrical signal as a further multiplier for the reference or set value at the output of the multiplier stage. The further multiplier signal then has the value 1 in the ineffective or inoperative state of the circuit as will be explained in more detail hereinbelow.

This further or fourth signal represents a further multiplier value for the reference value at the output of the multiplier stage and permits selectively performing a brief alteration of the warp thread tension or tensile stress periodic to the rotary speed of the machine or aperiodic thereto.

It is also of advantage for the regulation circuit which is arranged subsequent to the force transducer for measuring the tension force or tensile stress of the material or group of warp threads being unwound to be connected to an externally controlled source by which the tension force, under periodic or aperiodic control, can be altered. Such an arrangement permits long-term periodical or aperiodical alterations of the tension force or tensile stress in the material or group of warp threads being unwound or let-off.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE diagramatically illustrates a weaving machine according to the invention.

DETAILED DESCRIPTION OF THE PREFERRED EMBODIMENTS

Describing now the drawing, it is to be understood that to simplify the showing thereof, only enough of the structure of the regulation device has been illustrated therein as is needed to enable one skilled in the art to readily understand the underlying principles and concepts of this invention. Turning specifically now to the drawing, the apparatus illustrated therein by way of example and not limitation will be seen to comprise a supply roll or so-called warp beam or warp roller 1 which is driven by a drive motor 2 through an intermediate transmission or winding gearing 3. The rotary speed of the drive motor 2 is monitored by a tachometer 4 which is coupled to the drive motor 2 and generates electrical potential values proportional to the rotary speed of the motor 2. The electrical potential values are conducted to a regulation circuit arrangement 5 as momentary values for the power regulation of the drive motor 2.

The warp threads 6 unwound from the warp beam 1 are first led over a whip roll or guide roll 7 which serves to maintain the travel direction of the warp threads 6 constant. Subsequently, the warp threads 6 engage a swingingly supported sensor roll 8, which in this case is carried on a support 9 constructed as an elastic spring. This support 9 swings or pivots relative to a fixed point in proportion to the varying tensile stress or tension force in the unwinding material or threads 6.

A force transducer 10, 10' is arranged on the support 9 for generating an electrical signal E1 corresponding to the momentary tensile stress or tension force in the unwinding material or threads 6 and defining a warp tension signal. The electrical output signal E1 of this force transducer 10, 10' is connected through a regulation stage 13, which can for instance be a PI-regulator or a PID-regulator, and through a storage unit 14 to a first, warp-tension input E1 of a multiplier stage 15.

The warp threads 6 unwound from the warp beam 1 then arrive, after their deflection by the sensor roll 8, at a further processing or weaving stage 30 where a shed is formed by raising a portion of the warp threads and lowering the other portion, whereby warp threads of the upper shed 11' and warp threads of the lower shed 11 temporarily and alternatingly form the weaving shed through which a weft thread is inserted in suitable, not particularly shown conventional manner and then beat-up at the fell or beat-up edge 31 of the material or fabric 12 being woven. This process produces the finished material or fabric 12.

The finished material or fabric 12 is then taken-up by a fabric or loom take-up roll or breast beam 16 and wound up on a storage roll or so-called cloth roller 17. The breast beam 16 is rotatingly driven by a suitable regulator drive 18.

In order to obtain, in the present case, an electrical signal E2 corresponding to the take-up speed of the processed or woven material or fabric 12 and defining a fabric speed signal, a rotary speed measuring device determining the rotary speed of the breast beam 16 or of the regulator drive 18 or a speed measurement device 25 measuring the take-up speed of the processed or woven material or fabric 12 is provided whose output signal is conducted through a converter 20 to a further, fabric speed input E2 of the multiplier stage 15. The speed measurement device 25 comprises a sensor 19 detecting the rotary speed of the regulator drive 18.

An electrical signal A then appears at the output of the multiplier stage 15 which has a value corresponding to the product of the input signals E1, E2. This signal A is conducted to the regulation circuit arrangement 5 as a reference or set value for the power regulation of the drive motor 2.

By this feedback regulation of the rotary drive of the warp beam 1 according to the invention in dependence of the momentary tensile stress or tension force in the unwinding material or group of warp threads 6 and the momentary take-up speed of the processed material or woven fabric 12 by, in the present case, a multiplication of the corresponding potential values of the signals E1 and E2 for generating the appropriate reference or set value signal A for the rotary drive, it is now possible to achieve a high constancy of the tensile stress or tension force in the unwinding material or group of warp threads even under non-uniform conditions in the further processing of the material or fabric 12 woven from the warp threads 6.

It will be readily recognized that, under constant take-up speed or under only very slowly altered take-up speed, as is usually the case under normal production conditions of a uniform material or fabric, a feedback regulation of the rotary drive of the warp beam 1 occurs only in relation to the motions of the sensor roll 8, i.e. of its support 9, i.e. of the signal of the force transducer 10'. If, however, an alteration of the take-up speed occurs, perhaps intentionally by means of a programmed change in the type of material or fabric being woven—for instance by varying the warp thread spacing or by providing a fringe border—or unintentionally due to disturbances in processing operation, then the reference value A generated by the multiplier stage 15 will also immediately change in correspondence to the change in the signal E2 representing the take-up speed, and therefore the unwinding or let-off speed of the warp threads 6 from the warp beam 1, will be feedback regulated without the tensile stress or tension force in the unwinding warp threads 6 varying.

As can also be seen from the illustrated circuit block diagram, a third, selective external signal input E3 is provided for the multiplier stage 15, preferably connectable thereto alternatively with the second input E2 by means of a switch 32. Electrical signals of an externally controlled source 21 can be conducted to the multiplier stage 15 through the third input E3.

By this measure it is possible to generate a reference or set value A at the output of the multiplier stage 15 in dependence of the input signal E3 from the externally controlled source 21 while eliminating the electrical signal E2 corresponding to the take-up speed of the processed material or fabric 12. This makes it possible, as previously mentioned, to perform idle functions on the weaving machine, such as for instance a controlled relaxation of the warp threads in the idle state or a pre-stressing of the warp threads when restarting the machine by appropriately regulating the rotary drive of the warp beam 1.

Additionally, a further, continuous external signal input can be provided for the multiplier stage 15, as shown in phantom line in the FIGURE. The further input is connected to a circuit 22 for generating an electrical signal E4 defining a continuous external signal which has a value of 0 in the effective or operative state and a value of 1 in the ineffective or inoperative state of this circuit. This signal E4 represents a further multiplier value for the reference value A at the output of the multiplier stage 15 and permits selectively undertaking a brief and rapidly effective alteration of the warp thread tension periodic to the rotary speed of the machine or aperiodic thereto, for instance a periodic increase of the warp thread tension at the moment of weft thread insertion when weaving very dense fabrics.

As can be further seen from the FIGURE, a further circuit or switching stage 26 is connected to the regulator drive 13. This circuit permits a controlled, long-term and gradually effective alteration of the tension force of the unwinding material or warp threads 6, for instance for achieving effects in goods or fabrics which can be achieved by altering the tension force of the warp threads.

A regulation device for the rotary drive of a warp beam of a weaving machine therefore results from the previous description which, comparatively, permits the known state of the art a very individual and precise regulation in dependence of various parameters.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A regulation device for a rotary drive of a supply roll device, especially for a warp beam of a weaving machine, for generating as uniform as possible a tension force upon a material being let-off in the form of warp threads and conducted to a further processing device and to a fabric take-up device, comprising:

a tachometer coupled with said rotary drive;

a drive motor of said rotary drive;

a power regulator connected to said drive motor;

said tachometer serving as a momentary value transducer for said power regulator;

first means for generating a first electrical signal corresponding to said tension force in said material being let-off in the form of warp threads;

second means for generating a second electrical signal in correspondence to a take-up speed of the fabric woven from the warp threads;

a multiplier stage connected to said first and second means and delivering an output signal;

said first and second electrical signals being input to said multiplier stage;

said output signal being conducted to said power regulator as a reference value for the rotary drive;

regulation means;

signal storage means connected with said regulation means;

said multiplier stage having a warp tension input;

said first means for generating said first electrical signal comprising a swingingly supported sensor roll engaging said material being let-off in the form of warp threads and a force transducer; and said force transducer being connected through said regulation means and said signal storage means to said warp tension input of said multiplier stage.

2. The regulation device as defined in claim 1, further including:

externally controlled means for periodic alteration of said tension force of said material being let-off in the form of warp threads and connected to said regulation means.

3. The regulation device as defined in claim 1, further including:

externally controlled means for aperiodic alteration of said tension force of said material being let-off in the form of warp threads and connected to said regulation means.

4. A regulation device for a rotary drive of a supply roll device, especially for a warp beam of a weaving machine, for generating as uniform as possible a tension force upon a material being let-off in the form of warp threads and conducted to a further processing device and to a fabric take-up device, comprising:

a tachometer coupled with said rotary drive;

a drive motor of said rotary device;

a power regulator connected to said drive motor;

said tachometer serving as a momentary value transducer for said power regulator;

first means for generating a first electrical signal corresponding to said tension force in said material being let-off in the form of warp threads;

second means for generating a second electrical signal in correspondence to a take-up speed of the fabric woven from the warp threads;

a multiplier stage connected to said first and second means and delivering an output signal;

said first and second electrical signals being input to said multiplier stage;

said output signal being conducted to said power regulator as a reference value for the rotary drive;

a regulator drive;

a converter circuit cooperating with said regulator drive;

said multiplier stage having a fabric speed input;

said second means for generating said second electrical signal comprising a cloth roller upon which said material being woven into a fabric from said warp threads is taken up and a device for determining the rotational speed of said regulator drive;

said cloth roller being rotatingly driven by means of said regulator drive;

said device for determining said rotational speed being connected through said converter circuit to said fabric speed input of said multiplier stage;

an externally controlled source for generating a first multiplier signal independent of the take-up speed of said fabric being woven;

said multiplier stage having a selective external control input; and said externally controlled source being connected to said multiplier stage by means of said selective external control input.

5. The regulation device as defined in claim 4, further including:

switch means; and said fabric speed input and said selective external control input being alternatively connectable to said multiplier stage by said switch means.

6. The regulation device as defined in claim 4, further including:

a circuit for generating a third electrical signal;

said multiplier stage having an output;

said third electrical signal serving as a second multiplier signal for said reference value which appears at said output of said multiplier stage;

said multiplier stage having a continuous external control input; and said multiplier stage being connected through said continuous external control input to said circuit for generating said third electrical signal.

7. The regulation device as defined in claim 6, wherein:

said second multiplier signal is capable of assuming a value of 0 and a value of 1; and said second multiplier signal having a value of 1 when said circuit is inoperative.

* * * * *